US008061028B2

(12) United States Patent
Takahashi et al.

(10) Patent No.: US 8,061,028 B2
(45) Date of Patent: Nov. 22, 2011

(54) FIXED SCROLL POSITIONING APPARATUS AND FIXED SCROLL POSITIONING METHOD

(75) Inventors: Takayuki Takahashi, Osaka (JP); Toshihiro Susa, Osaka (JP); Kazuhiro Furusho, Osaka (JP); Atsushi Suhara, Shiga (JP); Takashi Hirouchi, Osaka (JP); Tetsuo Nakata, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 643 days.

(21) Appl. No.: 11/795,334

(22) PCT Filed: Jan. 19, 2006

(86) PCT No.: PCT/JP2006/000717

§ 371 (c)(1),
(2), (4) Date: Jul. 16, 2007

(87) PCT Pub. No.: WO2006/080230

PCT Pub. Date: Aug. 3, 2006

(65) Prior Publication Data

US 2008/0152527 A1 Jun. 26, 2008

(30) Foreign Application Priority Data

Jan. 31, 2005 (JP) ..... 2005-023074
Jan. 31, 2005 (JP) ..... 2005-023557

(51) Int. Cl.

| | |
|---|---|
| ***B23P 15/00*** | (2006.01) |
| ***B23P 19/00*** | (2006.01) |
| ***B23P 19/10*** | (2006.01) |
| ***B23P 21/00*** | (2006.01) |

(52) U.S. Cl. ..... 29/888.022; 29/888.02; 29/407.1; 29/407.09; 29/407.02; 29/709; 29/714; 29/721

(58) Field of Classification Search ..... 418/55.1, 418/55.2, 1; 29/888.022, 888.021, 888.02, 29/407.1, 407.09, 407.01, 407.02, 709, 714, 29/720, 721

See application file for complete search history.

(56) References Cited

U.S. PATENT DOCUMENTS

| | | | | | |
|---|---|---|---|---|---|
| 4,552,517 | A | * | 11/1985 | Shimizu | 418/55.1 |
| 4,649,611 | A | * | 3/1987 | Ikeda et al. | 29/888.022 |
| 4,706,353 | A | * | 11/1987 | Zgliczynski et al. | 29/888.025 |
| 5,103,558 | A | * | 4/1992 | Herrick et al. | 29/888.022 |
| 5,290,160 | A | * | 3/1994 | Ito et al. | 418/55.1 |
| 5,984,653 | A | * | 11/1999 | Misiak | 418/55.1 |
| 6,109,101 | A | | 8/2000 | Iwabuchi et al. | |
| 6,142,754 | A | * | 11/2000 | Hsiao et al. | 418/55.1 |

(Continued)

FOREIGN PATENT DOCUMENTS

JP 61-135995 A 6/1986

(Continued)

*Primary Examiner* — Mary A Davis
(74) *Attorney, Agent, or Firm* — Birch, Stewart, Kolasch & Birch, LLP.

(57) ABSTRACT

In a positioning apparatus (40), a fixed scroll (34) is positioned with respect to an assembly body (11) in which a compressor motor (25) has been incorporated. In positioning the fixed scroll (34), electric power is supplied to the compressor motor (25) from an inverter (81) to rotate a crank shaft (20) by the compressor motor (25), thereby shifting a movable scroll (31). In the positioning apparatus (40), the shift of the movable scroll (31) leads to calculation of an appropriate position of the fixed scroll (34). A striking unit (70) applies impact force to the fixed scroll (34) to stir the fixed scroll (34) to the appropriate position.

7 Claims, 9 Drawing Sheets

U.S. PATENT DOCUMENTS

| | | | | |
|---|---|---|---|---|
| 6,616,429 | B1 * | 9/2003 | Weber et al. | 418/55.1 |
| 6,618,931 | B2 * | 9/2003 | Takeda et al. | 29/707 |
| 6,814,554 | B1 * | 11/2004 | Chang et al. | 418/55.1 |
| 2002/0062560 | A1 * | 5/2002 | Takeda et al. | 29/888.022 |
| 2003/0072630 | A1 * | 4/2003 | Kato | 409/230 |
| 2004/0052469 | A1 | 3/2004 | Munekata et al. | |
| 2006/0093505 | A1 * | 5/2006 | Tarng et al. | 418/55.1 |
| 2006/0140807 | A1 * | 6/2006 | Chang et al. | 418/55.5 |
| 2008/0092385 | A1 * | 4/2008 | Susa et al. | 29/888.022 |

FOREIGN PATENT DOCUMENTS

| | | | |
|---|---|---|---|
| JP | 2-283881 | A | 11/1990 |
| JP | 3-267690 | A | 11/1991 |
| JP | 4-104023 | A | 4/1992 |
| JP | 5-24356 | B | 4/1993 |
| JP | 8-267146 | A | 10/1996 |
| JP | 9-250476 | A | 9/1997 |
| JP | 10-134502 | A | 5/1998 |
| JP | 2000-64968 | A | 3/2000 |
| JP | 2002-70763 | A | 3/2002 |
| JP | 2002-81385 | A | 3/2002 |
| JP | 2002-228870 | A | 8/2002 |
| JP | 2002-292577 | A | 10/2002 |

* cited by examiner

FIXED SCROLL POSITIONING APPARATUS AND FIXED SCROLL POSITIONING METHOD

TECHNICAL FIELD

The present invention relates to a method and an apparatus for positioning a fixed scroll in assembling a scroll fluid machinery.

BACKGROUND ART

Conventionally, scroll fluid machineries are widely used in compressors provided for compressing refrigerant in refrigeration circuits such as air conditioners. In a scroll fluid machinery, a fixed side volute rap and a movable side volute rap are provided at a fixed scroll and a movable scroll, respectively, so as to engage with each other to form a fluid chamber. In the scroll fluid machinery, the movable scroll revolves to change the volume of the fluid chamber. For example, in a scroll compressor, the volume of the fluid chamber in a closed state decreases, thereby compressing the fluid in the fluid chamber.

In this way, the movable scroll revolves with its rap engaging with the rap of the fixed scroll in the scroll fluid machinery. In order to move the movable scroll smoothly, the fixed scroll must be arranged accurately at the position where the rap of the revolving movable scroll evades hard contact with the rap of the fixed scroll. For this reason, the fixed scroll must be positioned accurately in assembling the scroll fluid machinery. Methods and apparatuses for positioning the fixed scroll have been disclosed in Patent Document 1 and Patent Document 2, for example.

Specifically, in the positioning method disclosed in Patent Document, an assembly body is prepared first by assembling a movable scroll, a crank shaft engaged therewith, and a bearing for the crank shaft. Next, a fixed scroll is engaged with the movable scroll of the assembly body, and then, the crank shaft in this state is rotated by a motor. Then, variation in torque necessary for rotating the crank shaft is detected, and a contact degree and a contact direction of the fixed scroll to the movable scroll are calculated on the basis of the detected torque variation. Subsequently, a distance by and direction in which the fixed scroll is to be moved are lead out according to the contact degree and the contact direction of the fixed scroll to the movable scroll, and then, the fixed scroll is moved on the basis of the lead out distance and direction.

Referring to the positioning method disclosed in Patent Document 2, an assembly body is prepared first by assembling a movable scroll, a crank shaft engaged therewith, and a bearing for the crank shaft. Next, a fixed scroll is engaged with the movable scroll of the assembly body, and then, the crank shaft is rotated 90° by 90° in this state by a motor. Wherein, the fixed scroll is moved until the rap of the movable scroll and the rap of the fixed scroll are in contact with each other at each rotation angle 0°, 90°, 180°, 270° of the crank shaft. Then, the position where the fixed scroll is to be arranged is calculated on the basis of the amount of the movement of the fixed scroll in each rotation angle of the crank shaft, and then, the fixed scroll is moved to the calculated position.

Patent Document 1: Japanese Patent Publication No. 05-024356A

Patent Document 2: Japanese Patent Application Laid Open Publication No. 2002-081385A,

SUMMARY OF THE INVENTION

Problems that the Invention is to Solve

The crank shaft engaged with the movable scroll must be rotated for positioning the fixed scroll in each method disclosed in Patent Document 1 or Patent Document 2. Under the circumstances, in each conventional positioning method disclosed in Patent Document 1 or Patent Document 2, a serve motor is joined to the crank shaft by means of a detachable coupling and is electrified to rotate the crank shaft.

Referring to a hermetic scroll fluid machinery, it includes a motor (an electric motor) for driving the crank shaft. However, in order to position the fixed scroll according to each method disclosed in Japanese Patent Publication No. 05-024356A or Japanese Patent Application Laid Open Publication No. 2002-081385A, even for assembling a scroll fluid machinery including a motor for drive, such a hermetic scroll compressor, for example, the crank shaft must be rotated by a servo motor other than the components of the assembly body. In other words, another servo motor exclusively used for positioning must be prepared to rotate the crank shaft. This invites complication of the equipment for positioning the fixed scroll.

The present invention has been made in view of the foregoing and has its object of simplifying equipment necessary for positioning a fixed scroll in assembling a scroll fluid machinery.

Means of Solving the Problems

The first invention directs to an apparatus for positioning a fixed scroll (34) on the basis of a positional relationship between a rap (35) of the fixed scroll (34) and a rap (32) of a movable scroll (31) in an assembling process of a scroll fluid machinery (10) that includes a drive motor (25). The apparatus includes: a fixing member (63) for fixing an assembly body (11) composed of an integrated combination of the movable scroll (31), a crank shaft (20) engaged with the movable scroll (31), a housing member (36) serving as a bearing for the crank shaft (20), and the drive motor (25) for driving the crank shaft (20); power supply means (83) for supplying electric power to the drive motor (25) to shift the movable scroll (31) of the assembly body (11); determining means (80) for determining a stirring distance and a stirring direction of the fixed scroll (34) by shifting the movable scroll (31) engaged with the fixed scroll (34); and a stirring mechanism (75) for stirring the fixed scroll (34) according to the stirring distance and the stirring direction determined by the determining means (80).

In the first invention, the assembly body (11) is held by the fixing member (63) and the movable scroll (31) of the assembly body (11) is engaged with the fixed scroll (34). In this state, the power supply means (83) supplies electric power to the drive motor (25) to rotate the crank shaft (20), thereby moving the movable scroll (31). Namely, in this positioning apparatus (40), the crank shaft (20) is rotated by utilizing the drive motor (25) mounted, as a component of the scroll fluid machinery (10), to the crank shaft (20). The determining means (80) determines a direction and a distance where the fixed scroll (34) is to be moved for optimizing the positional relationship between the rap (35) of the fixed scroll (34) and the rap (32) of the movable scroll (31) in such a manner that the crank shaft (20) is rotated to change the position of the movable scroll (31). The stirring mechanism (75) stirs the fixed scroll (34) according to the stirring distance and the stirring direction determined by the determining means (80). Whereby, the fixed scroll (34) is arranged at an appropriate position.

In the second invention, the determining means (80) of the first invention determines the stirring distance and the stirring direction of the fixed scroll (34) so that the rap (35) of the fixed scroll (34) is out of contact with the rap (32) of the movable scroll (31) regardless of the position of the movable scroll (31).

In the second invention, the determining means (80) determines the direction and the distance where the fixed scroll (34) is to be moved so that the rap (35) of the fixed scroll (34) is out of contact with the rap (32) of the movable scroll (31). Because, if the rap (32) of the movable scroll (31) would get into hard contact with the rap (35) of the fixed scroll (34), the movable scroll (31) could not be moved smoothly. In view of this disadvantage, the position of the fixed scroll (34) is optimized so that the raps (32, 35) of the movable scroll (31) and the fixed scroll (34) are out of contact with each other in this invention.

Referring to the third invention, in the first or second invention, the determining means (80) determines the stirring distance and the stirring direction of the fixed scroll (34) on the basis of change in rotation torque of the drive motor (25).

In the third invention, the determining means (80) monitors the rotation torque of the drive motor (25), that is, torque necessary for rotating the crank shaft (20) engaged with the movable scroll (31). If the fixed scroll (34) would be arranged at an inappropriate position, the rap (32) of the movable scroll (31) would be in contact with the rap (35) of the fixed scroll (34) to increase the torque necessary for rotating the crank shaft (20) instantly. Therefore, the determining means (80) determines the distance and the direction where the fixed scroll (34) is to be moved for optimizing the positional relationship between the rap (35) of the fixed scroll (34) and the rap (32) of the movable scroll (31) on the basis of the change in rotation torque of the drive motor (25).

Referring to the fourth invention, in the first invention, the apparatus further includes: a pressing mechanism for pressing the fixed scroll (34) engaged with the movable scroll (31) against the housing member (36), wherein the stirring mechanism (75) stirs the fixed scroll (34) by applying impact force to the fixed scroll (34) being pressed against the housing member (36).

In the fourth invention, the pressing mechanism (56) presses the fixed scroll (34) against the housing member (36). The stirring mechanism (75) applies impact force to the fixed scroll (34) to stir the fixed scroll (34) being pressed against the housing member (36).

In conventional general positioning apparatuses, the fixed scroll is stirred by continuously applying the pressing force to the fixed scroll by a servo motor or the like. For this reason, at the instant when the pressing force by the servo motor or the like surpasses static friction force working on the fixed scroll, the fixed scroll is stirred largely. This involves difficulty in reliable movement of the fixed scroll by a necessary distance. To tackling this problem, the position of the fixed scroll may be adjusted in the condition that the friction force does not work on the fixed scroll with the fixed scroll held at a position slightly apart from the housing member. However, positioning of the fixed scroll with the fixed scroll floating above the housing member may displace the fixed scroll from the determined position when the fixed scroll is made in contact with the housing member after the positioning.

In contrast, in the fourth invention, the stirring mechanism (75) applies impact force (that is, instant striking force) to stir the fixed scroll (34). When the impact force applied to the fixed scroll (34) surpass the static friction force working on the fixed scroll (34), the fixed scroll (34) starts stirring. However, the impact force works only instantly and the impact force working on the fixed scroll (34) becomes smaller than the friction force immediately after the fixed scroll (34) starts stirring, so that the fixed scroll (34) stops immediately. In this way, when the impact force is applied to the fixed scroll (34), the fixed scroll (34) being pressed against the housing member (36) stirs by a slight distance. Thus, the positioning apparatus (40) of this invention adjusts the position of the fixed scroll (34) by stirring the fixed scroll (34) little by little.

Referring to the fifth invention, in the fourth invention, the fixing member (63) pinches and fixes the assembly body (11) at a part near the movable scroll (31) of the assembly body (11).

In the fifth invention, the assembly body (11) is fixed at a part thereof near the movable scroll (31), namely, a part thereof near the contact face between the fixed scroll (34) and the housing member (36). When the fixed scroll (34) is stirred, the friction force works on the contact face between the fixed scroll (34) and the housing member (36). In this invention, the distance between the point where the friction force works and a point where the fixing member (63) holds the assembly body (11) is set short. Hence, the moment working on the assembly body (11) becomes small at generation of the friction force.

Referring to the sixth invention, in the fourth or fifth invention, the apparatus further includes: a base member (46) on which the assembly body (11) is placed, the base member (46) including a guide member (51) for guiding the assembly body (11) to a predetermined position in placing the assembly body (11) onto the base member (46).

In the sixth invention, the assembly body (11) is placed on the base member (46). At that time, the assembly body (11) is lead to a predetermined position on the base member (43) by the guide member (51). The guidance of the assembly body (11) to the predetermined position by the guide member (51) eliminates the need to adjust the position of the assembly body (11) on the base member (46).

Referring to the seventh invention, in the sixth invention, the apparatus further includes: a rotary encoder (53) mounted to the base member (46) and engaged with the crank shaft (20), wherein rotation speed of the drive motor (25) is controlled by utilizing an output of the rotary encoder (53).

In the seventh invention, the rotary encoder (53) is engaged with the crank shaft (20) that is driven by the drive motor (25). The rotary encoder (53) detects and outputs the rotation speed of the crank shaft (20). The positioning apparatus (40) of this invention controls the rotation speed of the drive motor (25) by utilizing the output of the rotary encoder (53).

The eighth invention directs to a method for positioning a fixed scroll (34) on the basis of a positional relationship between a rap (35) of the fixed scroll (34) and a rap (32) of a movable scroll (31) in a process of assembling a scroll fluid machinery (10) that includes a drive motor (25). The method includes: a first step of fixing an assembly body (11) composed of an integrated combination of the movable scroll (31), a crank shat (20) engaged with the movable scroll (34), a housing member (36) serving as a bearing for the crank shaft (20), and the drive motor (25) for driving the crank shaft (20) and engaging the fixed scroll (34) with the movable scroll (31); a second step of determining a stirring distance and a stirring direction of the fixed scroll (34) in such a manner that the movable scroll (31) engaged with the fixed scroll (34) in the first step is shifted by electrifying the drive motor (25);

and a third step of stirring the fixed scroll (34) according to the stirring distance and the stirring direction determined in the second step.

In the eighth invention, the first step, the second step, and the third step are carried out to position the fixed scroll (34) with respect to the assembly body (11). In the second step, the electric power is supplied to the drive motor (25) to rotate the crank shaft (20) so that the movable scroll (31) engaged with the fixed scroll (34) in the first step is moved. Namely, in this positioning method, the crank shaft (20) is rotated by utilizing the drive motor (25) mounted, as a component of the scroll fluid machinery (10), to the crank shaft (20). Then, in the second step, the crank shaft (20) is rotated to change the position of the movable scroll (31), so that the stirring distance and the stirring direction of the fixed scroll (34) which are necessary for optimizing the positional relationship between the rap (35) of the fixed scroll (34) and the rap (32) of the movable scroll (31) are determined. In the third step, the fixed scroll (34) is stirred according to the stirring distance and the stirring direction determined in the second step to optimize the positional relationship between the raps (35, 32) of the fixed scroll (34) and the movable scroll (31).

Referring to the ninth invention, in the eighth invention, the stirring distance and the stirring direction are determined on the basis of change in rotation torque of the drive motor (25) in the second step.

In the ninth invention, in the second step, the rotation torque of the drive motor (25), that is, the torque necessary for rotating the crank shaft (20) engaged with the movable scroll (31) is monitored. At the instant when the rap (32) of the movable scroll (31) is in contact with the rap (35) of the fixed scroll (34), the torque necessary for rotating the crank shaft (20) becomes large. In this viewpoint, in the second step, the position of the fixed scroll (34) is determined on the basis of the change in rotation torque of the drive motor (25) so that the positional relationship between the rap (35) of the fixed scroll (34) and the rap (32) of the movable scroll (31) is optimized.

Effects of the Invention

In the positioning apparatus (40) and the positioning method according to the present invention, the movable scroll (31) is shifted by rotating the crank shaft (20) by the drive motor (25) in positioning the fixed scroll (34). In other words, for moving the movable scroll (31) in positioning the fixed scroll (34) the drive motor (25) as a component of the finished scroll fluid machinery (10) is utilized in place of a servo motor exclusively prepared for positioning as in the conventional case. Accordingly, in the present invention, an additional motor for rotating the crank shaft (20) in positioning the fixed scroll (34) is dispensed with, simplifying equipment used for positioning the fixed scroll (34).

In the case where the crank shaft (20) is rotated by a servo motor exclusively used for positioning the fixed scroll (34), as in the conventional case, the servo motor must be joined to the crank shaft (20) by means of a detachable coupling. However, if the servo motor would be joined to the crank shaft (20) by means of such a detachable coupling, "unfavorable friction" would be caused between the coupling and the crank shaft. This "unfavorable friction" may disable reliable transmission of the torque generated by the servo motor to the crank shaft. Consequently, in judgment on the basis of the rotation torque of the crank shaft as to whether or not the position of the fixed scroll (34) is appropriate in the conventional method, the "unfavorable friction" between the coupling and the crank shaft inhibits accurate detection of the rotation torque generated at the servo motor. This may invite difficulty in performing accurate and reliable positioning of the fixed scroll.

In contrast, according to the third and ninth inventions, in the present invention in which the crank shat (20) is rotated by utilizing the drive motor (25) as a component of the scroll fluid machinery (10), the appropriate position of the fixed scroll (34) is calculated on the basis of the change in rotation torque of the drive motor (25). In other words, in the present invention, for moving the movable scroll (31) in positioning the fixed scroll (34), the drive motor (25) firmly fixed to the crank shaft (20) as a component of the finished scroll fluid machinery (10) is utilized, rather than a servo motor mounted to the crank shaft by means of the coupling only for positioning as in the conventional case. As a result, the rotation torque generated at the drive motor (25) is transmitted to the crank shaft (20) reliably.

In consequence, according to the third and ninth inventions, influence of the coupling for joining the servo motor to the crank shat (20) as in the conventional case can be eliminated, and detection of the rotation torque generated at the drive motor (25) enables accurate acquisition of torque necessary for rotating the crank shaft (20). Also enabled is accurate detection of the contact degree between the rap (35) of the fixed scroll (34) and the rap (32) of the movable scroll (31) in positioning the fixed scroll (34), increasing the positioning accuracy of the fixed scroll (34).

In the positioning apparatus (40) according to the fourth invention, the stirring mechanism (75) applies impact force to the fixed scroll (34) to stir the fixed scroll (34). Therefore, the fixed scroll (34) being pressed against the housing member (36) can be stirred by a slight distance reliably, attaining delicate position adjustment of the fixed scroll (34). Further, in this invention, the positioning of the fixed scroll (34) is performed in the condition that the fixed scroll is pressed against the housing member (36). When the fixed scroll (34) being pressed against the housing member (36) is fixed to the housing member (36) by means of a bolt or the like, the fixed scroll (34) is fixed accurately at the position determined by the determining means (80). Hence, according to this invention, the fixed scroll (34) can be positioned reliably with high accuracy in assembling the scroll fluid machinery (10).

According to the fifth invention, the moment working on the assembly body (11) at stirring of the fixed scroll (34) can be minimized. Accordingly, the assembly body (11) can be held stably with comparatively small force in positioning the fixed scroll (34).

In the sixth invention, the assembly body (11) is guided to a predetermined point by the guide member (51) in placing the assembly body (11) onto the base member (46). Therefore, the assembly body (11) can be placed at an appropriate position on the base member (46) reliably with less attention paid to the position where the assembly body (11) is to be placed. Thus, according to this invention, operation for placing the assembly body (11) onto the base member (46) can be facilitated.

In the seventh invention, the rotation speed of the drive motor (25) is controlled by utilizing the output of the rotary encoder (53). The control of the rotation speed of the drive motor (25) leads to control of the moving speed of the movable scroll (31). Hence, according to this invention, the stirring distance and the stirring direction of the fixed scroll (34) can be determined accurately by the determining means (80).

EXPLANATION OF REFERENCE NUMERALS

Figure 1:
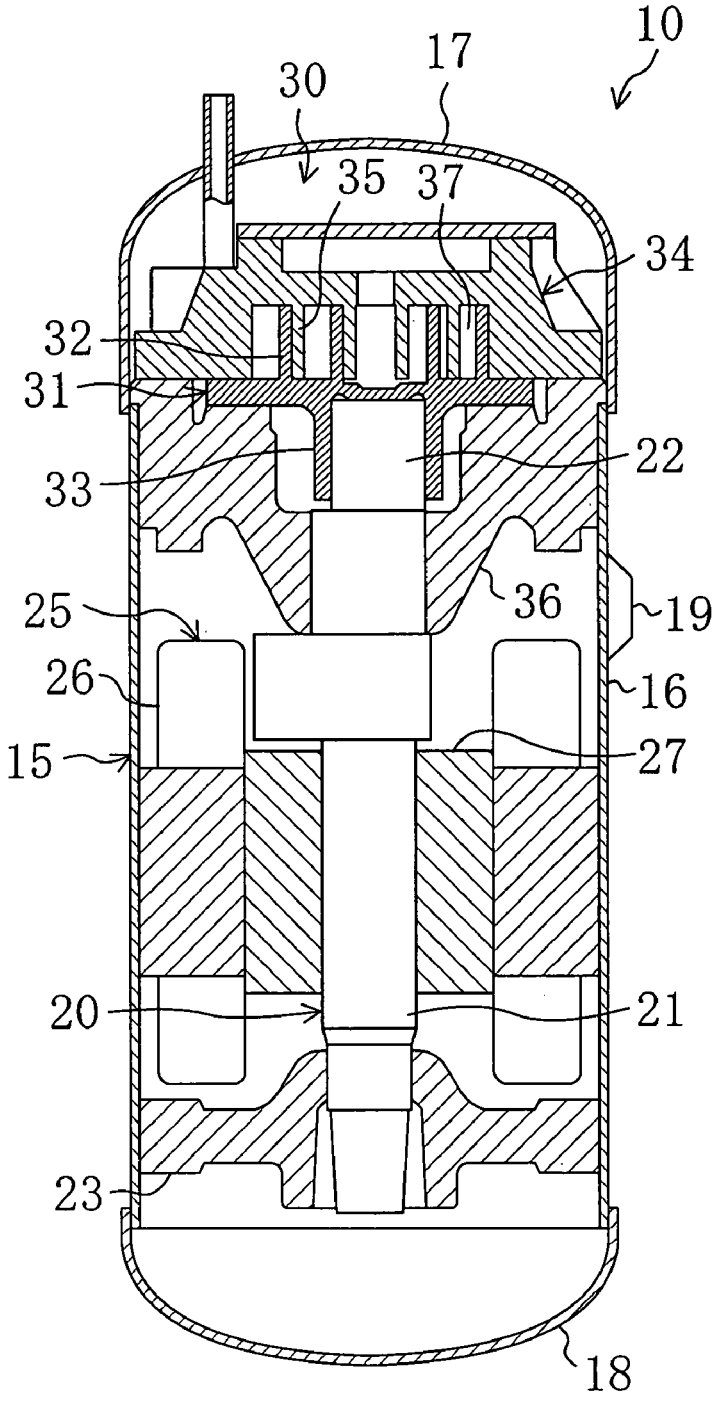
FIG. 1 is a vertical section showing a schematic construction of a scroll compressor.

10 scroll compressor (scroll fluid machinery)
11 assembly body
20 crank shaft
25 compressor motor (drive motor)
31 movable scroll
32 movable side rap
34 fixed scroll
35 fixed side rap
36 housing (housing member)
45 base member
51 guide member
53 rotary encoder
56 pressing mechanism
63 fixing member
75 stirring mechanism
80 controller (determining means)
83 power supply means

BEST MODE FOR CARRYING OUT THE INVENTION

The embodiments of the present invention will be described below with reference to the accompanying drawings.

<Construction of Scroll Compressor>

The construction of a scroll compressor (10) assembled using a positioning apparatus (40) according to the present invention will be described first.

As shown in FIG. 1, the scroll compressor (10) is formed hermetically as a whole. The scroll compressor (10) includes a casing (15) in the form of a longitudinal hermetic container. The casing (15) is composed of one body member (16) having a longitudinally cylindrical shape and end plate members (17, 18) formed in cap shapes and respectively mounted at the upper end and the lower end of the body member (16).

In the casing (15), a lower bearing member (23), a compressor motor (25), and a compression mechanism (30) are arranged in this order from the lower side to the upper side. Also, a crank shaft (20) is provided in the casing (15) so as to extend vertically.

The crank shaft (20) includes a main shaft portion (21) and an eccentric portion (22). The main shaft portion (21) has an upper end part of which diameter is slightly large. The eccentric portion (22) is in a column shape of which diameter is smaller than that of the main shaft portion (21) and stands on the upper end face of the main shaft portion (21). The eccentric portion (22) has an axial center eccentric away from the axial center of the main shaft portion (21).

The lower bearing member (23) is fixed at the vicinity of the lower end of the body member (16) of the casing (15). A plain bearing is formed at the central part of the lower bearing member (23) for rotatably supporting the lower end of the main shaft portion (21).

A generally-called blushless DC motor is used as the compressor motor (25). The compressor motor (25) includes a stator (26) and a rotor (27) to compose a drive motor. The stator (26) is fixed to the body member (16) of the casing (15). The stator (26) is connected electrically to a power supply terminal (19) mounted at the body member (16) of the casing (15). On the other hand, the rotor (27) is arranged inside the stator (26) and is fixed to the main shaft portion (21) of the crank shaft (20).

The compression mechanism (30) includes a movable scroll (31), a fixed scroll (34), and a housing (36) as a housing member.

The housing (36) is in a comparatively thick disk shape of which central part is recessed, and is joined at the outer peripheral part thereof to the upper end of the body member (16). The main shaft portion (21) of the crank shaft (20) is inserted in the central part of the housing (36). The housing (36) composes a bearing for rotatably supporting the main shaft portion (21) of the crank shaft (20).

The movable scroll (31) includes a movable side rap (32) in the form of a volute wall standing on the front face (the upper face in FIG. 1) thereof and a cylindrical protruding portion (33) protruding from the back face (the lower face in FIG. 1) thereof. The movable scroll (31) is mounted on the upper face of the housing (36) through an Oldham ring (not shown). The eccentric portion (22) of the crank shaft (20) is inserted in the protruding portion (33) of the movable scroll (31). Namely, the movable scroll (31) is engaged with the crank shaft (20).

The fixed scroll (34) is formed in a comparatively thick disc shape. A fixed side rap (35) in the form of a volute wall is provided at the central part of the fixed scroll (34). The fixed side rap (35) is formed by scraping the fixed scroll (34) from the lower face thereof.

Figure 2:
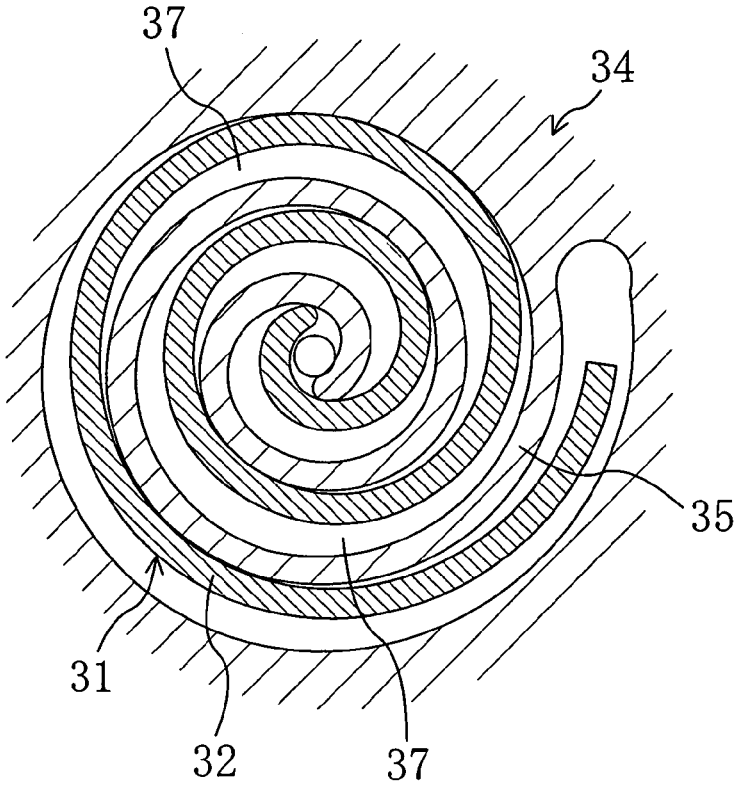
FIG. 2 is a transverse section showing a main part of the scroll compressor.

As shown in FIG. 2, in the compression mechanism (30), the fixed side rap (35) of the fixed scroll (34) and the movable side rap (32) of the movable scroll (31) are engaged with each other. The engagement of the fixed side rap (35) and the movable side rap (32) forms a plurality of compression chambers (37).

Embodiment 1 of the Invention

The positioning apparatus (40) according to Embodiment 1 of the present invention and a method for positioning the fixed scroll (34) which is performed by the positioning apparatus (40) will be described.

—Fixed Scroll Positioning Apparatus—

The positioning apparatus (40) of the present embodiment is used for positioning the fixed scroll (34) in a process of assembling the scroll compressor (10). Specifically, the positioning apparatus (40) optimizes the positional relationship between the fixed scroll (34) and the movable scroll (31) by adjusting the position of the fixed scroll (34) in mounting the fixed scroll (34) to an assembly body (11) formed in the course of assembling the scroll compressor (10).

The assembly body (11) is composed of an integrated combination of the body member (16), the housing (36), the compressor motor (25), the lower bearing member (23), the crank shaft (20), and the movable scroll (31). In the assembly body (11), the housing (36), the compressor motor (25), and the lower bearing member (23) are fixed to the body member (16) and the movable scroll (31) is mounted on the housing (36) with the crank shaft (20) engaged therewith. Also, in the assembly body (11), the stator (26) of the compressor motor (25) is connected to the power supply terminal (19) electrically.

Figure 3:
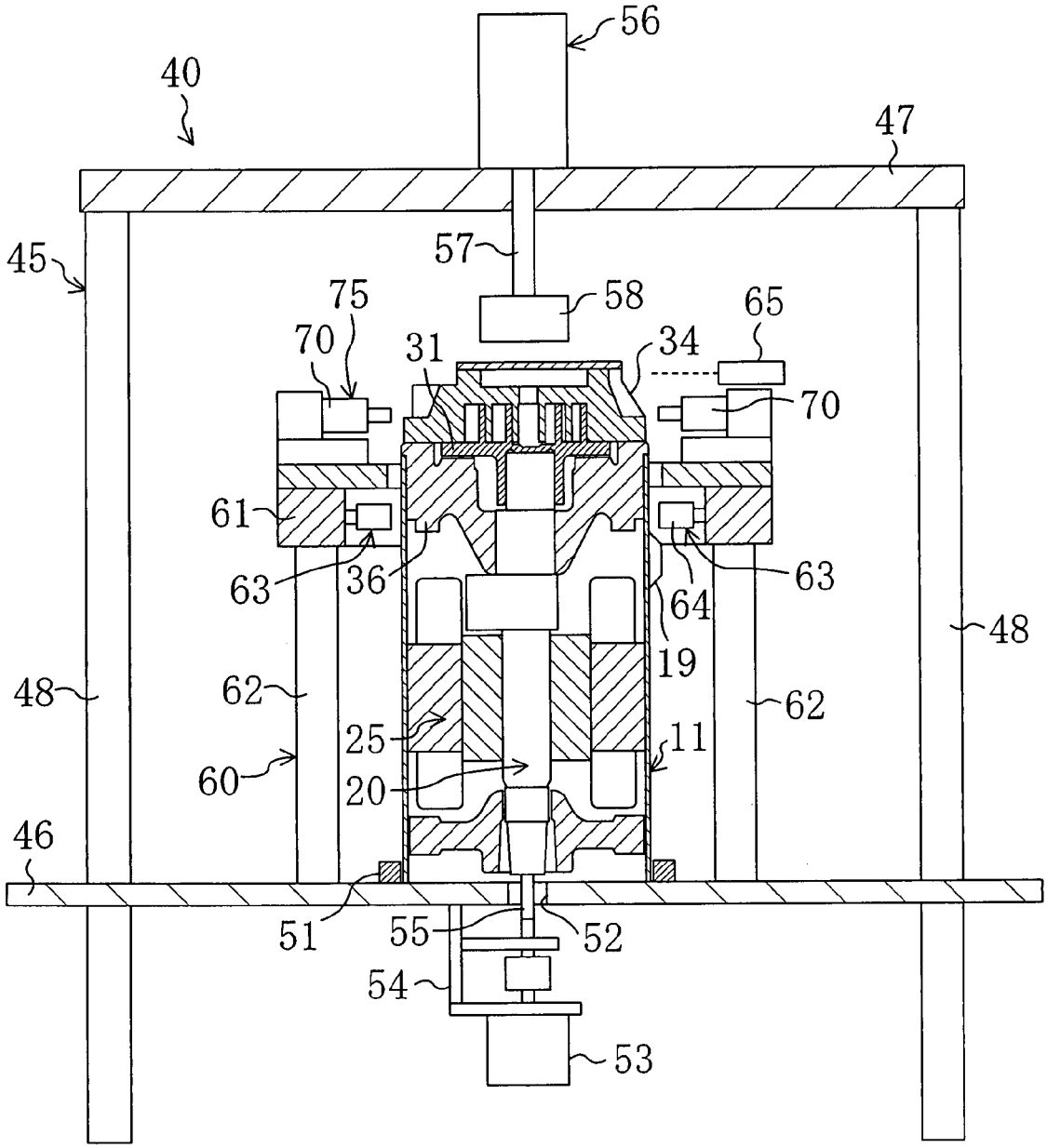
FIG. 3 is a front view showing a schematic construction of a positioning apparatus according to Embodiment 1.

The construction of the aforementioned positioning apparatus (40) will be described with reference to FIG. 3 and FIG. 4. The positioning apparatus (40) includes a first frame body (45) and a second frame body (60).

The first frame body (45) includes one mount plate (46), one upper plate (47), and four pole members (48). The mount plate (46) is formed in a rectangular shape and is arranged substantially horizontally. The pole members (48) stand at the respective corners of the mount plate (46). The pole members (48) pass through the mount plate (46) so as to protrude at the lower ends thereof downwards from the mount plate (46). The upper plate (47) is placed on the four standing pole members (48).

A ring-shaped guide member (51) protrudes from the central part of the upper face of the mount plate (46). The guide member (51) is provided for guiding the body member (16) to a predetermined position in placing the assembly body (11) onto the mount plate (46) and has an inner diameter slightly larger than the outer diameter of the body member (16) of the assembly body (11). A through hole (52) is formed at the center of the mount plate (46). The through hole (52) is a circular hole coaxial with the guide member (51) and passes through the mount plate (46).

A rotary encoder (53) is mounted under the mount plate (46) by means of a bracket (54). The rotary encoder (53) is arranged below the through hole (52) and has a rotary shaft extending upward towards the through hole (52). A coupling (55) is mounted to the rotary shaft of the rotary encoder (53). The coupling (55) passes through the through hole (52) so as to protrude from the upper face of the mount plate (46) and is detachably fitted at the tip end thereof to the lower end of the crank shaft (20) of the assembly body (11).

A pressing mechanism (56) for pressing the fixed scroll (34) downwards is mounted to the upper plate (47). The pressing mechanism (56) includes a rod (57) extending downwards and is arranged at the substantial center of the upper plate (47). A pressing member (58) having a cross section larger than the rod (57) is mounted at the tip end of the rod (57). The pressing member (58) is in contact with the fixed scroll (34) placed on the housing (36) of the assembly body (11). The pressing mechanism (56) is so composed that the rod (57) is fed using a feed screw mechanism or the like to apply pressing force to the fixed scroll (34).

The second frame body (60) includes one frame member (61) and four pole members (62) and is fixed on the mount plate (46). Specifically, each pole member (62) has a length slightly shorter than the height of the body member (16) composing the assembly body (11). The four pole members (62) stand on the mount plate (46) at regular intervals left around the guide member (51). The frame member (61) is in the form of a rectangular or circular frame and is placed on the four pole members (62). The frame member (61) is fixed to the pole members (62) so as to surround the upper part of the assembly member (11).

A clamping mechanism (63) for fixing the assembly body (11) is provided at the frame member (61). The clamping mechanism (63) composes a fixing member. The clamping mechanism (63) includes a plurality of movable clamp heads (64) protruding inward of the frame member (61). The clamping mechanism (63) clamps the assembly body (11) in such a manner that the clumping heads (64) push the outer peripheral face of the body member (16) composing the assembly body (11) so as to pinch the assembly body (11) from the respective sides in the radial direction of the body member (16). The clamping mechanism (63) pinches the upper end part of the body member (16) of the casing (15), that is, a part thereof near the movable scroll (31) and the fixed scroll (34).

One laser displacement gauge (65) and four striking units (70) are arranged on the frame member (61). The laser displacement gauge (65) irradiates a laser beam to the fixed scroll (34) to measure a displacement amount of the fixed scroll (34). Each of the striking units (70) includes a main section (71) and an air cylinder section (100) and is in a column shape as a whole. The four striking units (70) compose a stirring mechanism (75) for stirring the fixed scroll (34). The construction of the striking units (70) will be described later.

Figure 4:
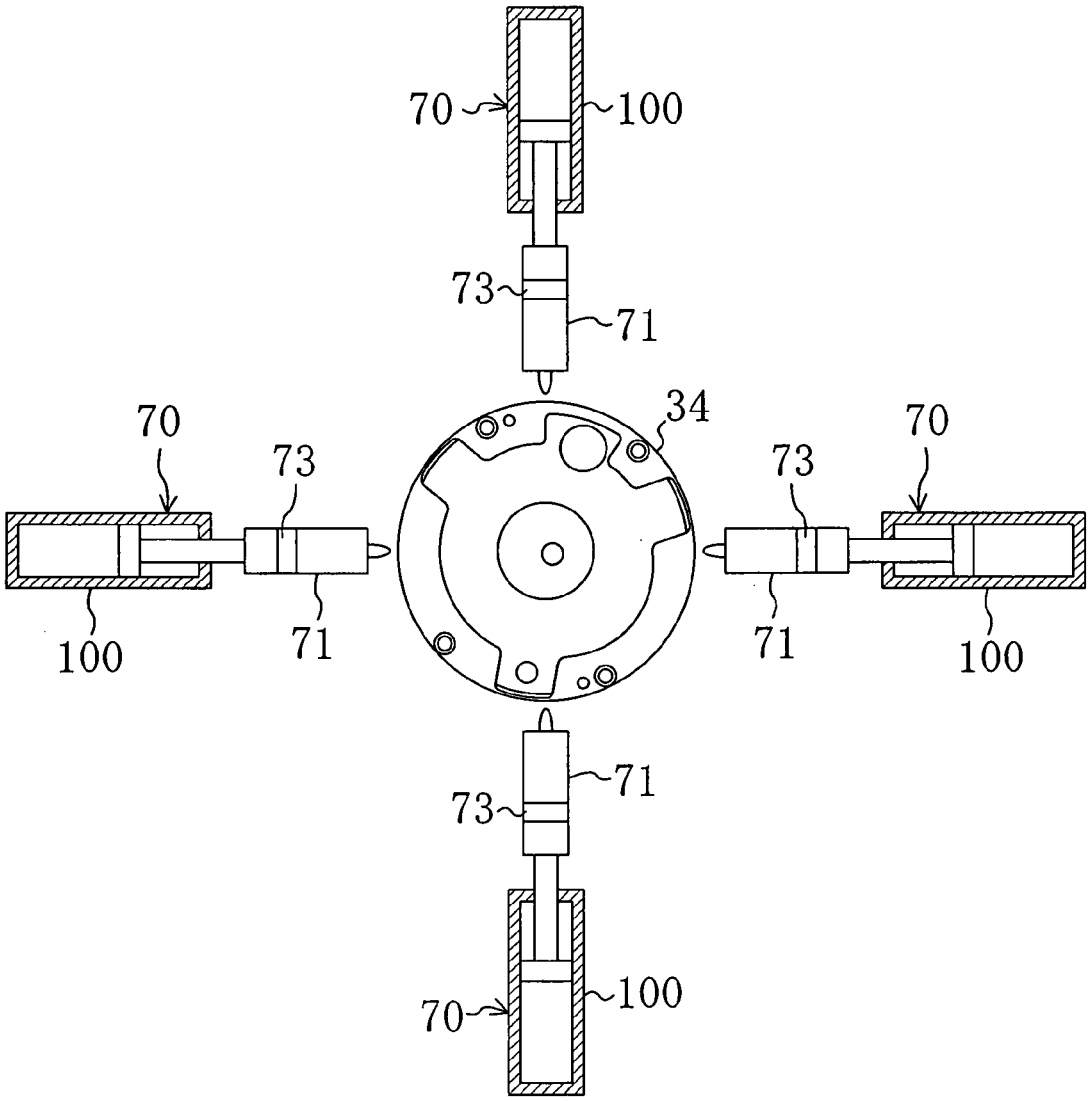
FIG. 4 is a plan view showing a main part of the positioning apparatus according to Embodiment 1.

As shown in FIG. 4, the four striking units (70) are arranged radially at intervals of 90° with the fixed scroll (34) on the housing (36) of the assembly body (11) as a center. Namely, two striking units (70) are arranged along a first radial direction of the fixed scroll (34) while the other two striking units (70) are arranged along a second radial direction that intersects at a right angle with the first radial direction. Further, each main section (71) of the pairs of two striking units (70) arranged along the corresponding radial direction faces the fixed scroll (34). In other words, the respective paired two striking units (70) arranged along the respective radial directions confront each other with the fixed scroll (34) interposed.

Figure 5A:
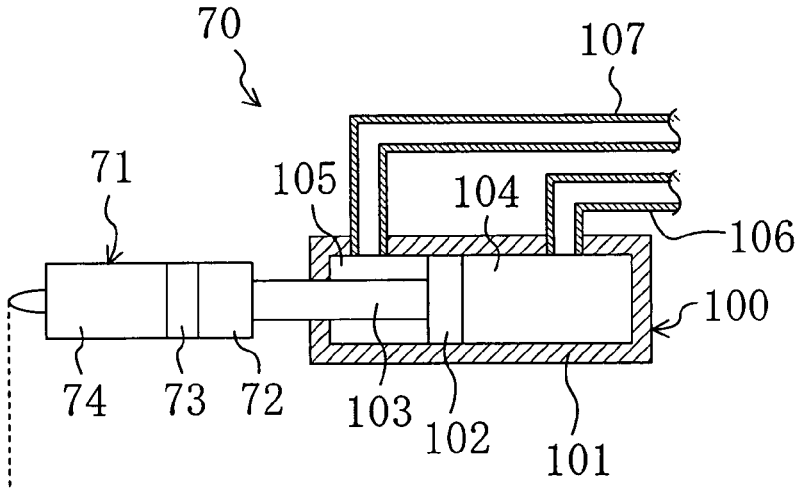
FIG. 5 is a schematic section showing a construction and operation of striking units according to Embodiment 1, wherein (A) shows a state that a piezoelectric element is not electrified and (B) shows a state that the piezoelectric element is electrified.
Figure 5B:
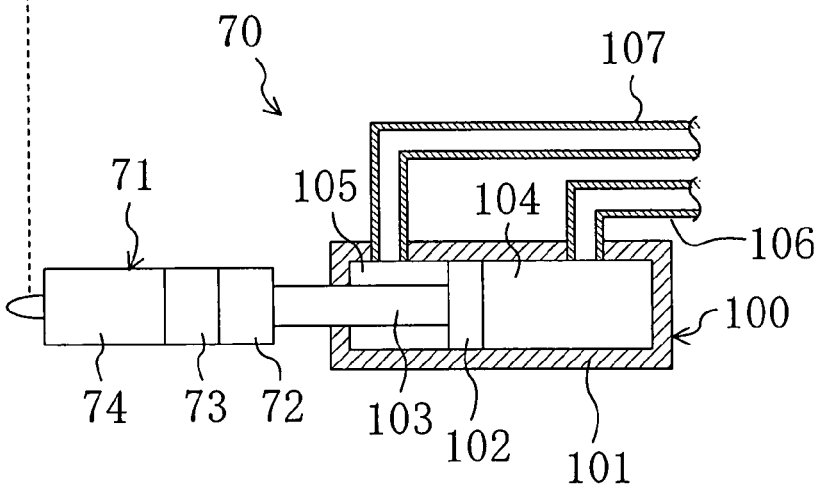

The construction of the striking units (70) will be described next with reference to FIG. 5. As described above, each of the striking units (70) includes one main section (71) and one air cylinder section (100). The main section (71) and the air cylinder section (100) have outer shapes in the form of columns and are arranged coaxially The main section (71) includes a base (72), a piezoelectric element (73), and a head portion (74) and is in a column shape as a whole. Specifically, in the main section (71), the base (72) and the head portion (74), which are in column shapes, are arranged coaxially, and the piezoelectric element (73) is interposed between the base (72) and the head portion (74). A stub is formed at the tip end of the head portion (74) (that is, on the side opposite the piezoelectric element (73)). In the main section (71), when voltage is applied to the piezoelectric element (73), the piezoelectric element (73) extends in the axial direction of the main section (71). In association with the extension of the piezoelectric element (73), the head portion (74) is pushed frontward (see FIG. 5(B)). When voltage application to the piezoelectric element (73) is halted, the piezoelectric element (73) returns to the original length, resulting in return of the head portion (74) to the original position (see FIG. 5(A)).

The air cylinder section (100) includes a cylinder (101), a piston (102), and a rod (103). The cylinder (101) is formed cylindrically so as to have a hollow therein. The piston (102) is inserted in the cylinder (101) so as to be movable in the axial direction of the cylinder (101). The rod (103) is arranged coaxially with the cylinder (101). The rod (103) has a base end connected to the piston (102) and a tip end extending outside the cylinder (101). The tip end of the rod (103) is joined to the end face of the base (72) of the main section (71). The inside of the cylinder (101) is divided by the piston (102) into a first air chamber (104) and a second air chamber (105). A first air pipe (106) is connected to the first air chamber (104)

on the side opposite the rod (103) while a second air pipe (107) is connected to the second air chamber (105) on the rod (103) side.

In each of the striking units (70), when air is supplied through the first air pipe (106) to the first air chamber (104) and air is discharged from the second air chamber (105) through the second air pipe (107), the piston (102) moves towards the second air chamber (105) to feed the main section (71) towards the tip end of the striking unit (70) (leftwards in FIG. 5). In reverse, when air is supplied through the second air pipe (107) to the second air chamber (105) and air is discharged from the first air chamber (104) through the first air pipe (106), the piston (102) moves towards the first air chamber (104) to return the main section (71) backwards to the base end of the striking unit (70) (rightwards in FIG. 5).

Figure 6:
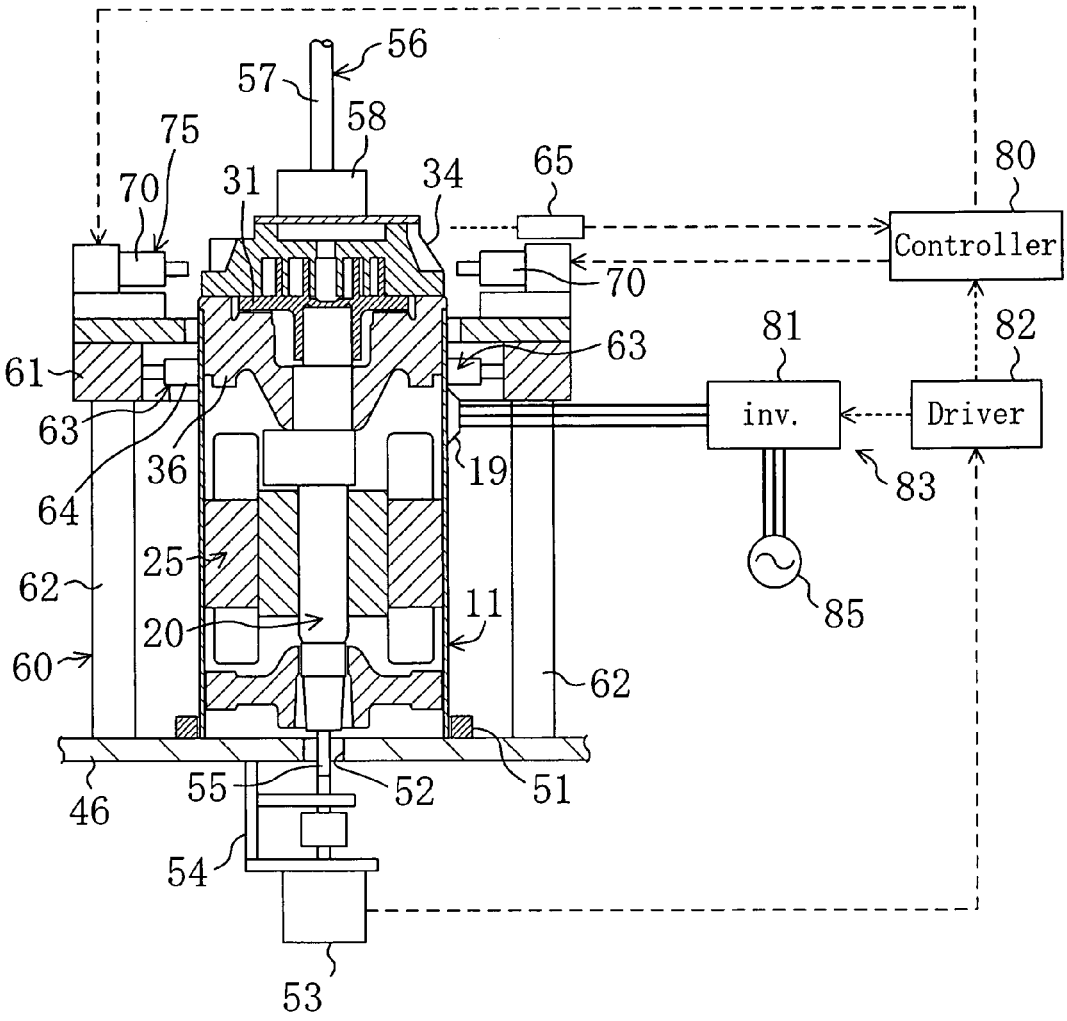
FIG. 6 is a schematic view of the positioning apparatus according to Embodiment 1.

As shown in FIG. 6, the positioning apparatus (40) is provided with an inverter (81), a driver (82) for the inverter (81), and a controller (80). The inverter (81) and the driver (82) compose power supply means (83).

The inverter (81) is connected at an input side thereof to a utility power source (85) and is connected at an output side thereof to the power supply terminal (19) of the assembly body (11). The driver (82) receives an output signal of the rotary encoder (53). The driver (82) calculates a rotation angle and an angular velocity of the crank shaft (20) on the basis of the output signal of the rotary encoder (53) and determines an instruction value relating to an output current value and an output frequency of the inverter (81) according to the calculation result. Then, the driver (82) outputs an instruction relating to switching timing and the like to the inverter (81) so that the output of the inverter (81) corresponds to the instruction value. The inverter (81) operates according to the instruction from the driver (82) and supplies an alternating current to the compressor motor (25) of the assembly body (11).

The controller (80) composes determining means. The controller (80) receives from the driver (82) an instruction value relating to the output current of the inverter (81) and information on the rotation angle of the crank shaft (20). The controller (80) monitors change in rotational toque (that is, output torque) of the compressor motor (25) during the rotation of the crank shaft (20) with the use of the instruction value and the like of the output current of the inverter (81). Further, the controller (80) determines a direction in and a distance by which the fixed scroll (34) is to be stirred on the basis of the change in output torque of the compressor motor (25), and then, applies pulse voltage to the piezoelectric element (73) of a target striking unit (70) according to the determination.

Further, though hot shown, the positioning apparatus (40) includes a laser displacement gauge for measuring the phase of the crank shaft (20). The laser displacement gauge for phase measurement calculates the phase of the crank shaft (20) by measuring the position of the eccentric portion (22).

—Fixed Scroll Positioning Method—

A method for positioning the fixed scroll (34) which the positioning apparatus (40) performs will be described next.

First, a first step of the positioning method is carried out. In the first step, the assembly body (11) is placed on the mount plate (46) with the housing (36) located up. In the state that the assembly body (11) is mounted on the mount plate (46), the lower end of the body member (16) is fitted inside the guide member (51) and the lower end face of the crank shaft (20) is located above the through hole (52). In this state, the assembly body (11) is fixed to the positioning apparatus (40). Specifically, in the positioning apparatus (40), the clamp heads (64) of the clamping mechanism (63) are fed towards the assembly body (11) and clamp the upper end part of the body member (16) from the respective sides so as to restrict the movement of the assembly body (11). In the state that the assembly body (11) is fixed by the clamping mechanism (63), the rotary encoder (53) is joined to the lower end of the crank shaft (20) by means of the coupling (55).

Until the rotary encoder (53) is joined to the crank shaft (20), the movable scroll (31) is not mounted yet to the assembly body (11) with the eccentric portion (22) of the crank shaft (20) exposed. The inverter (81) is connected to the power supply terminal (19) of the assembly body (11) in this state. When the power is supplied to the compressor motor (25), the crank shaft (20) is driven and rotated at a given speed. The laser displacement gauge (not shown) for phase measurement measures a distance to the eccentric portion (22) of the rotating crank shaft (20) and inputs the result to the controller (80). The controller (80) calculates a phase of the crank shaft (20) on the basis of the input from the laser displacement gauge for phase measurement and the input from the rotary encoder (53). Also, the controller (80) stores change in output torque of the compressor motor (25) in the condition that the crank shaft (20) is rotated solely.

Thereafter, the movable scroll (31) is mounted to the assembly body (11) and the fixed scroll (34) is engaged with the movable scroll (31) of the assembly body (11). In detail, the fixed scroll (34) is placed on the housing (36) with the tip end of the fixed side rap (35) facing downwards so as to be in contact at the lower face thereof with the upper face of the housing (36). Accordingly, the fixed side rap (35) and the movable side rap (32), which are in the forms of volute walls, are engaged with each other. At this time point, an operator inserts a provisional positioning pin into the fixed side rap (35) so that the fixed side rap (35) is positioned temporally.

Subsequently, in the first step, the rod (57) of the pressing mechanism (56) is fed downwards to press the pressing member (58) against the upper face of the fixed scroll (34). As a result, the fixed scroll (34) is pressed against the housing (36) by the pressing member (58) of the pressing mechanism (56). Then, the operator takes out the provisional positioning pin from the fixed scroll (34).

Next, a second step of the positioning method is carried out. In the second step, electric power is supplied to the compressor motor (25) from the inverter (81) to rotate the crank shaft (20). In association with the rotation of the crank shaft (20), the movable scroll (31) moves. At this time point, the inverter (81) receives from the driver (82) an output instruction based on an output signal of the rotary encoder (53) and the like, so that the compressor motor (25) rotates at a given rotation speed.

During the rotation of the crank shaft (20), the controller (80) monitors change in output torque of the compressor motor (25). When the rap (32) of the movable scroll (31) is out of contact with the rap (35) of the fixed scroll (34), actual change in output torque of the compressor motor (25) substantially follows the change therein in the condition that the crank shaft (20) is rotated solely. At the time when the movable side rap (32) of the movable scroll (31) becomes in contact with the fixed side rap (35) of the fixed scroll (34), the actual output torque of the compressor motor (25) increases. Accordingly, difference of the actual change in output torque of the compressor motor (25) from that in the condition that the crank shaft (20) is rotated solely leads to judgment of the movable side rap (32) being in contact with the fixed side rap (35) at a point where the changes differ from each other. Therefore, the controller (80) judges the contact position and the contact degree between the movable scroll (31) and the fixed scroll (34) on the basis of the change in rotation torque of the compressor motor (25).

Further, on the basis of the contact position and the contact degree between the raps (32, 35) of the movable scroll (31) and the fixed scroll (34), the controller (80) determines a stirring distance and a stirring direction of the fixed scroll (34) which are necessary for evading contact between the raps (32, 35).

Next, the third step is carried out. In the third step, the controller (80) controls the operation of the striking units (70) to apply impact force to the fixed scroll (34) so that the fixed scroll (34) is stirred in the direction and by the distance determined in the second step.

Operation of the controller (80) will be described with reference to FIG. 4. Wherein, the respective terms, "right," "left," "upper," and "lower" in this paragraph correspond to those in FIG. 4. In order to stir the fixed scroll (34) leftward, the controller (80) supplies pulse voltage to the striking unit (70) on the right side to apply leftward impact force to the fixed scroll (34). In order to stir the fixed scroll (34) rightward, the controller (80) supplies pulse voltage to the striking unit (70) on the left side to apply rightward impact force to the fixed scroll (34). In order to stir the fixed scroll (34) downwards, the controller (80) supplies pulse voltage to the striking unit (70) on the upper side to apply downward impact force to the fixed scroll (34). In order to stir the fixed scroll (34) upwards, the controller (80) supplies pulse voltage to the striking unit (70) on the lower side to apply upward impact force to the fixed scroll (34). As well, in order to stir the fixed scroll (34) upper rightwards, for example, the controller (80) applies pulse voltage to the respective striking units (70) on the left side and the lower side to apply rightward impact force and upward impact force to the fixed scroll (34).

Operation for controlling the striking units (70) by the controller (80) will be described in detail with reference to FIG. 5.

First, the controller (80) moves the main section (71) of a target striking unit (70) so that the stub of the head portion (74) of the striking unit (70) is in contact with the fixed scroll (34). Specifically, the controller (80) performs control in such a manner that air is supplied through the first air pipe (106) to the first air chamber (104) and air is discharged from the second air chamber (105) through the second air pipe (107) to move the main section (71) towards the stub thereof.

When the head portion (74) is in contact with the fixed scroll (34) by moving the main section (71), the controller (80) applies pulse voltage to the piezoelectric element (73) of the main section (71). The application of the pulse voltage to the piezoelectric element (73) extends the piezoelectric element (73) according to the pulse waveform. At this time, the inertial force of the head portion (74) fed accompanied by the extension of the piezoelectric element (73) works on the fixed scroll (34) to stir the fixed scroll (34) slightly.

When the fixed scroll (34) is stirred, the head portion (74) separates from the fixed scroll (34). The main portion (71) of the striking unit (70) is moved again in order for the stub of the head portion (74) of the striking unit (70) to be in contact with the fixed scroll (34). Then, pulse voltage is applied again to the piezoelectric element (73) of the striking unit (70). Whereby, the piezoelectric element (73) extends to stir the fixed scroll (34) slightly.

Repetition of this operation moves the fixed scroll (34) being pressed against the housing (36) gradually. When the stirring of the fixed scroll (34) terminates, the controller (80) performs control in such a manner that the air is supplied to the second air chamber (105) through the second air pipe (107) and air is discharged from the first air chamber (104) through the first air pipe (106) to return the main portion (71) to the original position.

Furthermore, the controller (80) receives a stirring distance of the fixed scroll (34) which has been measured by the laser displacement gauge (65). Then, when the measured stirring distance of the fixed scroll (34) reaches a value necessary for evading the contact between the raps (32, 35), the supply of the pulse voltage to the striking unit (70) is halted.

In the third step, after the contact between the raps (32, 35) of the movable scroll (31) and the fixed scroll (34) is evaded, the fixed scroll (34) is fixed to the housing (36) subsequently. In the third step, the fixed scroll (34) and the housing (36) are joined with each other by means of a bolt (not shown). Thus, the fixed scroll (34) set at an appropriate position is fixed to the housing (36).

Effects of Embodiment 1

In the positioning apparatus (40) according to the present embodiment, the movable scroll (31) is moved by rotating the crank shaft (20) by the compressor motor (25) in positioning the fixed scroll (34). In other words, in the positioning apparatus (40) of the present embodiment, the compressor motor (25) as a component of the finished scroll fluid machinery (10) is utilized, rather than a servo motor exclusively prepared for positioning as in the conventional case, for moving the movable scroll (31) in positioning the fixed scroll (34). Accordingly, in the present embodiment, an additional motor for rotating the crank shaft (20) in positioning the fixed scroll (34) is dispensed with, simplifying the construction of the positioning apparatus (40).

In the positioning apparatus (40) and the positioning method according to the present embodiment, the crank shaft (20) is rotated by the compressor motor (25) to displace the movable scroll (31) in positioning the fixed scroll (34). In other words, in the present embodiment, the compressor motor (25) firmly fixed to crank shaft (20) as a component of the finished scroll fluid machinery (10) is utilized, rather than a servo motor mounted to the crank shaft (20) by means of a coupling only for positioning as in the conventional case, for moving the movable scroll (31) in positioning the fixed scroll (34). As a result, the rotation torque generated at the compressor motor (25) is transmitted to the crank shaft (20) reliably.

In consequence, according to the present embodiment, influence of the coupling for joining a servo motor to the crank shat (20) as in the conventional case can be eliminated, and detection of the rotation torque generated at the compressor motor (25) enables accurate acquisition of torque necessary for rotating the crank shaft (20). Also enabled is accurate detection of the contact degree between the rap (35) of the fixed scroll (34) and the rap (32) of the movable scroll (31) in positioning the fixed scroll (34), increasing the positioning accuracy of the fixed scroll (34).

In the positioning apparatus (40) according to the present embodiment, the stirring mechanism (75) applies impact force to the fixed scroll (34) to stir the fixed scroll (34). Therefore, the fixed scroll (34) being pressed against the housing member (36) can be stirred by a slight distance reliably, attaining delicate position adjustment of the fixed scroll (34). Further, in the present invention, the positioning of the fixed scroll (34) is performed in the condition that the fixed scroll (34) is pressed against the housing member (36). When the fixed scroll (34) being pressed against the housing member (36) is fixed to the housing member (36) by means of a bolt or the like, the fixed scroll (34) is fixed accurately at the position determined by the determining means (80). Hence, according to the present embodiment, the fixed scroll (34) can be positioned reliably with high accuracy in assembling the scroll fluid machinery (10).

Moreover, in the positioning apparatus (40) according to the present embodiment, the clamping mechanism (63) clamps the part near the movable scroll (31) and the fixed scroll (34) of the assembly body (11), so that the moment working on the assembly body (11) at stirring of the fixed scroll (34) with the use of the striking units (70) can be minimized. Accordingly, the assembly body (11) can be held stably with comparatively small power.

In the positioning apparatus (40) according to the present embodiment, the guide member (51) for guiding the assembly body (11) to a predetermined position is provided on the upper face of the mount plate (46). Accordingly, the assembly body (11) can be placed at an appropriate position on the mount plate (46) reliably with less attention paid to the position where the assembly body (11) is to be placed. Thus, according to the present embodiment, operation for placing the assembly body (11) onto the mount plate (46) can be facilitated.

Furthermore, in the positioning apparatus (40) according to the present embodiment, the rotation speed of the compressor motor (25) is controlled by utilizing the output of the rotary encoder (53). The control of the rotation speed of the compressor motor (25) leads to control of the moving speed of the movable scroll (31). Hence, the stirring distance and the stirring direction of the fixed scroll (34) can be determined accurately by the determining means (80).

Embodiment 2

Embodiment 2 of the present invention will be described. A positioning apparatus (40) of the present embodiment is the positioning apparatus (40) in Embodiment 1 to which a guide (41) is provided additionally.

Figure 7:
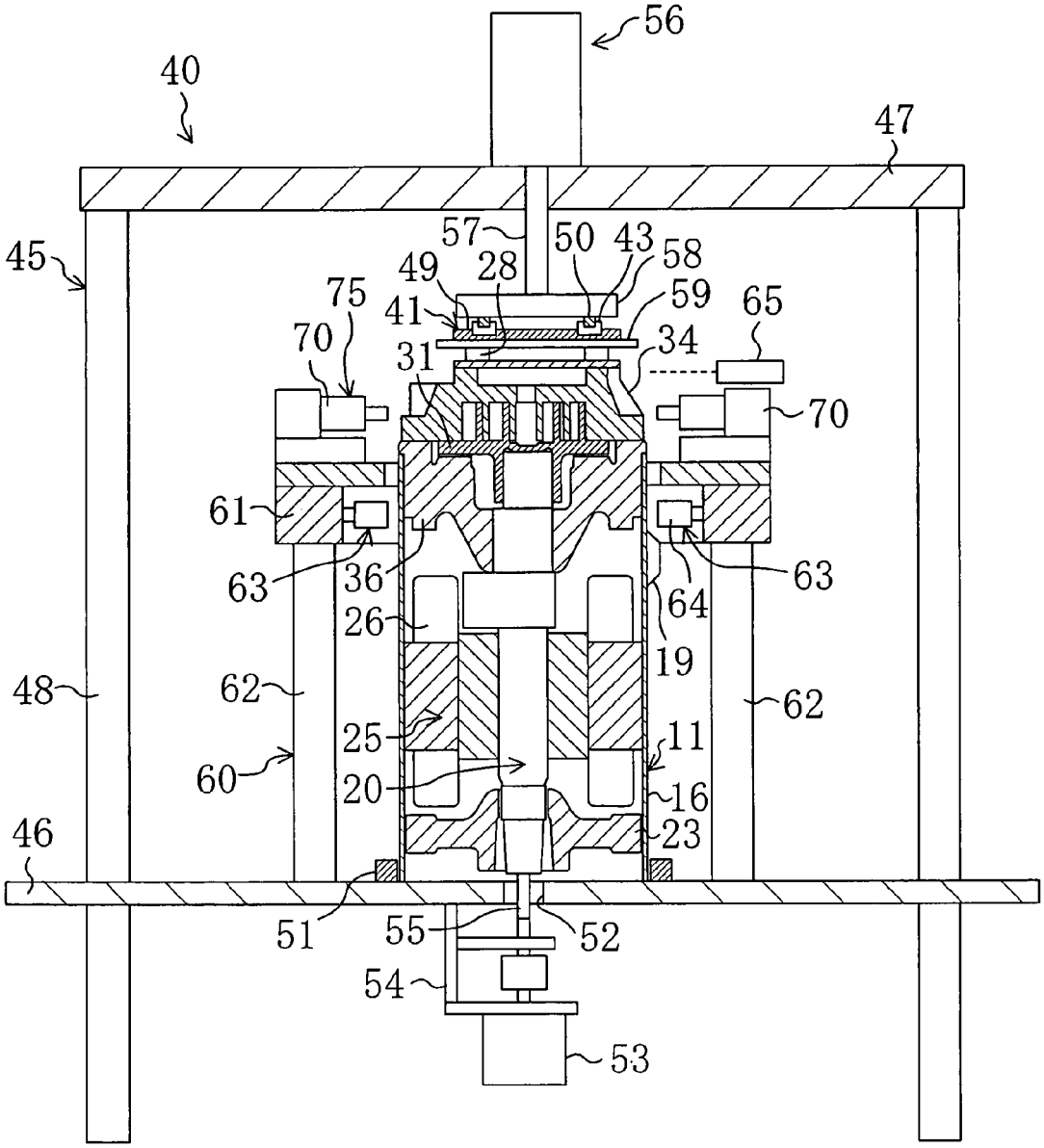
FIG. 7 is a front view showing a schematic construction of a positioning apparatus according to Embodiment 2.

As shown in FIG. 7, the guide (41) is arranged between the pressing member (58) of the pressing mechanism (56) and the fixed scroll (34). The pressing member (58) in the present embodiment is larger than that in Embodiment 1 so as to correspond to the size of the guide (41).

The construction of the guide (41) will be described with reference to FIG. 7 and FIG. 8. The guide (41) includes a base plate (59) formed in a rectangular flat plate, a pair of X axis rails (49), a pair of Y axis rails (50), stirring direction restricting members (43), and a shoe (28).

Figure 8:
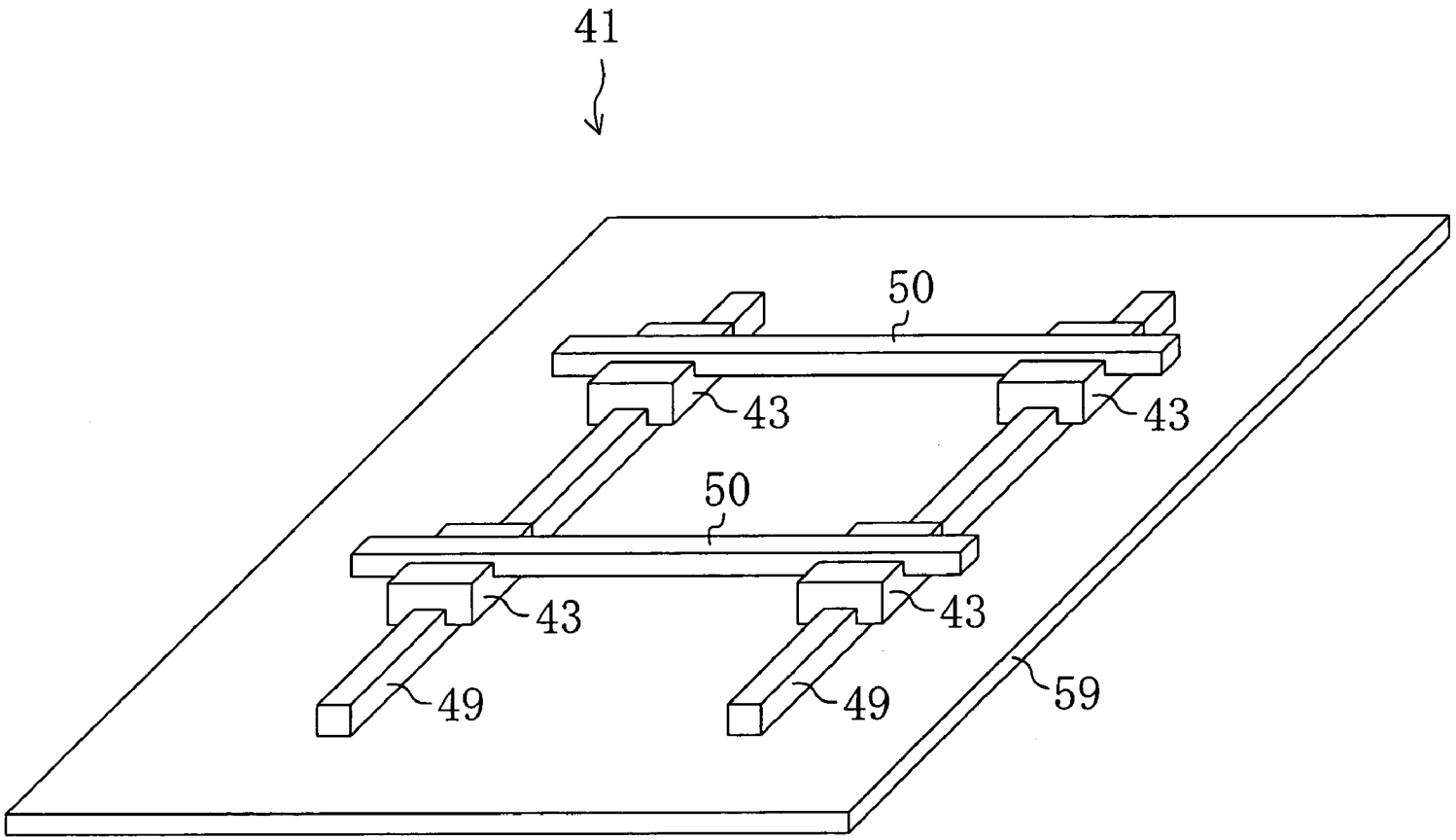
FIG. 8 is a perspective view showing a schematic construction of a guide according to Embodiment 2.

As shown in FIG. 8, the paired X rails (49) are fixed in parallel to each other at a predetermined distance left from each other on the upper face of the base plate (59). On the other hand, the paired Y axis rails (50) are fixed in parallel to each other at a predetermined distance left from each other on the lower face of the pressing member (58). The Y axis rails (50) are arranged so as to intersect at a right angle with the X axis rails (49).

The stirring direction restricting members (43) are arranged at the respective parts where the X axis rails (49) and the Y axis rails (50) intersect with each other. Namely, the guide (41) includes four stirring direction restricting members (43) in total. Each stirring direction restricting member (43), which is substantially in a cuboid shape, forms a groove in the X axis direction in the lower face portion and a groove in the Y axis direction in the upper face portion. In each stirring direction restricting member (43), one of the X axis rails (49) is fitted in the lower face groove and one of the Y axis rails (50) is fitted in the upper face groove. A plurality of ball members (not shown) are embedded in the grooves in the X axis direction and in the Y axis direction of each stirring direction restricting member (43). The stirring direction restricting members (43) are in contact with the X axis rails (49) and the Y axis rails (50) through the plural ball members so as to serve as rolling guides that move straight along the corresponding rails. Whereby, the guide (41) allows the fixed scroll (34) being pressed against the housing (36) to stir in parallel to the X axis direction or the Y axis direction, which intersect at a right angle with each other, while inhibiting the fixed scroll (34) from rotating.

The shoe (28) is in the form of a rod or a thin cuboid having a rectangular section and is fixed at the lower face of the base plate (59) (see FIG. 7). The shoe (28) is provided for inhibiting the fixed scroll (34) from sliding on the guide (41) in stirring the fixed scroll (34) which receives the pressing force from the guide (41). Therefore, the shoe (28) is so set to exert friction force working on the contact face between the shoe (28) and the fixed scroll (34) larger than friction force working on the contact face between the fixed scroll (34) and the housing (36).

In the guide (41), the direction in which the X axis rails (49) extend (X axis direction) is in parallel to the direction in which two of the striking units (70) confronting each other are arranged with the fixed scroll (34) interposed while the direction in which the Y axis rails (50) extend (Y axis direction) is in parallel to the direction in which the other two striking units (70) are arranged. In other words, in the positioning apparatus (40) of the present embodiment, the directions in which the guide (41) allows the fixed scroll (34) to stir (namely, the X axis direction and the Y axis direction) are consistent with the directions of impact force applied to the fixed scroll (34) by the striking units (70).

When one of the striking units (70) applies impact force in the X axis direction to the fixed scroll (34), the X axis rails (49) are guided to slide along the grooves of the corresponding stirring direction restricting members (43) to stir the fixed scroll (34) in the X axis direction. In contrast, when one of the striking units (70) applies impact force in the Y axis direction to the fixed scroll (34), the Y axis rails (50) are guided to slide along the grooves of the corresponding stirring direction restricting members (43) to stir the fixed scroll (34) in the Y axis direction.

Other Embodiments

The positioning apparatus (40) in each of the above embodiments may have any of the following constructions.

MODIFIED EXAMPLE 1

In the positioning apparatus (40) in each of the above embodiments may have a guide member (51) composed of a plurality of protruding members. The protruding members of this guide member (51) are arranged at regular angle intervals on the same circle. For example, for using a guide member (51) having four protruding members, the four protruding members are arranged radially at intervals of 90° with the through hole (52) as a center. In this case, the distance between two protruding members confronting each other with the through hole (52) interposed is slightly larger than the outer diameter of the body member (16).

Modified Example 2

Figure 9:
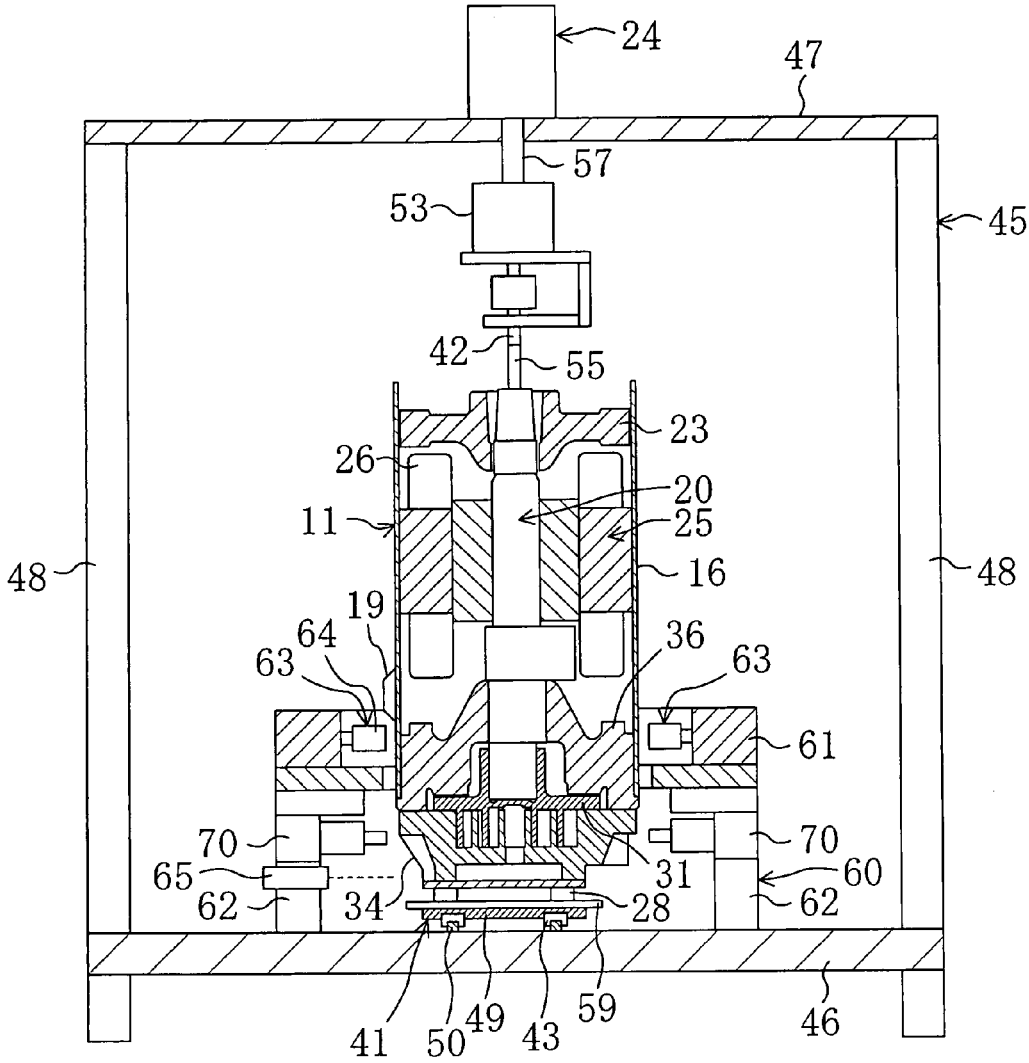
FIG. 9 is a front view showing a schematic construction of a positioning apparatus according to Modified Example 2 in the other embodiments.

In the positioning apparatus (40) in each of the above embodiments, the assembly body (11) may be arranged upside down on the mount plate (46). An apparatus in which the present modified example is applied to the positioning apparatus (40) of Embodiment 2 will be described herein with reference to FIG. 9.

In this positioning apparatus (40), the guide (41) is fixed at the central part on the upper face of the mount plate (46). The fixed scroll (34) is placed on the upper face of the base plate (59) of the guide (41) with the tip end of the fixed side rap (35) facing upwards. On the fixed scroll (34), the assembly body (11) is placed with the tip end of the movable side rap (32) of the movable scroll (31) facing downwards. The fixed scroll (34) and the movable scroll (31) are engaged with each other with the assembly body (11) placed on the fixed scroll (34).

The length of the pole members (62) is shorter than that in Embodiment 2 and is slightly longer than the height of the guide (41). Striking units (70) are fixed to the tip ends of three of the pole members (62). The laser displacement gauge (65) is fixed to the tip end of the other pole member (62) and the other striking unit (70) is fixed thereon. The frame member (61) is fixed above the striking units (70). The clamp mechanism (63) is provided at the frame member (61).

The upper plate (47) is placed on the tip ends of the pole members (48). An elevating machine (24) is provided at the center of the upper plate (47). The elevating machine (24) includes a rod (57) extending downwards. The rotary encoder (53) is mounted at the tip end of the rod (57). The elevating machine (24) is used for moving the rotary encoder (53) up and down. The rotary encoder (53) includes a rotary shaft (42) extending downwards. The coupling (55) is mounted at the tip end of the rotary shaft (42).

In this positioning apparatus (40), as described above, the fixed scroll (34) is placed on the upper face of the base plate (59) of the guide (41) and the assembly body (11) is placed thereon. In this condition, the assembly body (11) is clamped by the clamp mechanism (63). The elevating machine (24) moves the rotary encoder (53) downwards to join the coupling (55) to the crank shaft (20). In the positioning apparatus (40) of the present modified example, the fixed scroll (34) is positioned in this condition.

It should be noted that the above embodiments are substantially preferred examples and does not intend to limit the scopes of the present invention, applicable subjects, and uses.

Industrial Applicability

As described above, the present invention is useful for positioning a fixed scroll in assembling a scroll fluid machinery.

The invention claimed is:

1. A fixed scroll positioning apparatus for positioning a fixed scroll on the basis of a positional relationship between a rap of the fixed scroll and a rap of a movable scroll in an assembling process of a scroll fluid machinery, comprising:

a fixing member for fixing an assembly body composed of an integrated combination of the movable scroll, a crank shaft engaged with the movable scroll, a housing member serving as a bearing for the crank shaft, and a drive motor for driving the crank shaft;

power supply means for supplying electric power to the drive motor to shift the movable scroll of the assembly body;

determining means for determining a stirring distance and a stirring direction of the fixed scroll by shifting the movable scroll engaged with the fixed scroll; and a stirring mechanism for stirring the fixed scroll according to the stirring distance and the stirring direction determined by the determining means, wherein the power supply means includes an inverter for supplying power to the drive motor and a driver for controlling operation of the inverter, the driver determines an instruction value relating to an output current value and an output frequency of the inverter such that the drive motor rotates at a predetermined rotation speed, the driver controls operation of the inverter such that the output current value and the output frequency of the inverter correspond to the instruction value, the determining means detects change in rotational toque of the drive motor on the basis of change of the instruction value relating to the output current value of the inverter determined by the driver, the determining means determines the stirring distance and the stirring direction of the fixed scroll on the basis of change in rotation torque of the drive motor, and the drive motor is included in the assembled scroll fluid machinery.

2. The fixed scroll positioning apparatus of claim 1, wherein the determining means determines the stirring distance and the stirring direction of the fixed scroll so that the rap of the fixed scroll is out of contact with the rap of the movable scroll regardless of the position of the movable scroll.

3. The fixed scroll positioning apparatus of claim 1, further comprising:

a pressing mechanism for pressing the fixed scroll engaged with the movable scroll against the housing member, wherein the stirring mechanism stirs the fixed scroll by applying impact force to the fixed scroll being pressed against the housing member.

4. The fixed scroll positioning apparatus of claim 3, wherein the fixing member pinches and fixes the assembly body at a part near the movable scroll of the assembly body.

5. The fixed scroll positioning apparatus of claim 3, further comprising:

a base member on which the assembly body is placed, the base member including a guide member for guiding the assembly body to a predetermined position in placing the assembly body onto the base member.

6. The fixed scroll positioning apparatus of claim 5, further comprising:

a rotary encoder mounted to the base member and engaged with the crank shaft, wherein rotation speed of the drive motor is controlled by utilizing an output of the rotary encoder.

7. A fixed scroll positioning method for positioning a fixed scroll on the basis of a positional relationship between a rap of the fixed scroll and a rap of a movable scroll in a process of assembling a scroll fluid machinery, the method comprising:

a first step of fixing an assembly body composed of an integrated combination of the movable scroll, a crank shaft engaged with the movable scroll, a housing member serving as a bearing for the crank shaft, and a drive motor for driving the crank shaft and engaging the fixed scroll with the movable scroll;

a second step of determining a stirring distance and a stirring direction of the fixed scroll in such a manner that the movable scroll engaged with the fixed scroll in the first step is shifted by electrifying the drive motor; and a third step of stirring the fixed scroll according to the stirring distance and the stirring direction determined in the second step, wherein in the second step, a driver determines an instruction value relating to an output current value and an output frequency of an inverter such that the drive motor rotates at a predetermined rotation speed, and the driver controls operation of the inverter such that the output current value and the output frequency of the inverter correspond to the instruction value, in the second step, determining means detects change in rotational toque of the drive motor on the basis of change of the instruction value relating to the output current value of the inverter determined by the driver and the stirring distance and the stirring direction are determined on the basis of change in rotation torque of the drive motor, and the drive motor is included in the assembled scroll fluid machinery.

* * * * *

UNITED STATES PATENT AND TRADEMARK OFFICE

CERTIFICATE OF CORRECTION

PATENT NO. : 8,061,028 B2
APPLICATION NO. : 11/795334
DATED : November 22, 2011
INVENTOR(S) : Takayuki Takahashi et al.

It is certified that error appears in the above-identified patent and that said Letters Patent is hereby corrected as shown below:

ON THE TITLE PAGE:

At Item (86), change "PCT/JP2006/000717" to --PCT/JP2006/300717--.

Signed and Sealed this
Thirteenth Day of March, 2012

David J. Kappos

David J. Kappos
*Director of the United States Patent and Trademark Office*